United States Patent [19]

Larsen et al.

[11] 4,238,348

[45] Dec. 9, 1980

[54] METHOD AND A COMPOSITION FOR INHIBITING CORROSION

[75] Inventors: Arthur L. Larsen, Saltsjöbaden; Sören J. Marklund, Saltsjö-Boo; Jan Rosenblom, Saltsjöbaden, all of Sweden

[73] Assignee: Malaco AG, Zug, Switzerland

[21] Appl. No.: 959,081

[22] Filed: Nov. 9, 1978

[51] Int. Cl.[3] ..... C23F 11/16; C23F 11/14; C23F 11/12; E21B 43/22

[52] U.S. Cl. ..... 252/391; 106/14.13; 106/14.18; 106/14.42; 106/14.43; 252/8.55 D; 252/8.55 E; 252/392; 252/394; 422/12; 252/395

[58] Field of Search ..... 252/392, 391, 8.55 D, 252/8.55 E, 394, 395; 422/12; 106/14.13, 14.18, 14.42, 14.43

[56] References Cited

U.S. PATENT DOCUMENTS

| | | | |
|---|---|---|---|
| 3,119,447 | 1/1964 | Raifsnider et al. | 252/8.55 D |
| 3,121,091 | 2/1964 | Green | 252/391 |
| 3,629,104 | 12/1971 | Maddox | 252/8.55 E |
| 3,645,896 | 2/1972 | Larsen | 252/8.55 E |
| 3,712,863 | 1/1973 | Bundrant et al. | 252/8.55 E |
| 3,770,055 | 11/1973 | Larsen | 252/8.55 E |
| 3,976,593 | 8/1976 | Hartke et al. | 252/391 |

*Primary Examiner*—Benjamin R. Padgett
*Assistant Examiner*—Irwin Gluck
*Attorney, Agent, or Firm*—Fred Philpitt

[57] ABSTRACT

Corrosion of metals in contact with liquid systems is reduced by adding to the system a small amount of a carboxylic acid containing an organic hydrophobic group in combination with a sulfite or bisulfite of an amine. Preferred carboxylic acids and preferred sulfites are amino and amido carboxylic acids and preferred sulfites are those of ether amines. Combinations of the two types of compounds are particularly useful for preventing corrosion in different areas of oil recovery and in petroleum industry.

10 Claims, No Drawings

METHOD AND A COMPOSITION FOR INHIBITING CORROSION

The present invention relates to a method for treating corrosive systems to prevent corrosion of metals in contact with the systems and more particularly pertains to a method for preventing corrosion by utilization of a carboxylic acid in combination with an amine sulfite. The invention also relates to a composition for inhibiting corrosion.

Corrosion inhibitors are used both in aqueous and hydrocarbon systems for protection of metals, particularly ferrous metals. Sulfites of certain amines are previously known for use in corrosion protection whereby they function both as corrosion inhibitors and oxygen scavengers. Further nitrogen containing compounds such as quaternary ammonium compounds, fatty amine salts, sarcosine derivatives etc. are known corrosion inhibitors.

According to the present invention it has been found that a substantial reduction of corrosion of metal structures, such as ferrous pipes, tubing etc, is obtained by utilization of carboxylic acids in combination with an amine-sulfite. The substances can be introduced into aqueous systems such as cooling systems, systems for hydrostatic testing, water flooding systems in oil recovery etc, and into organic systems, particularly hydrocarbon systems, such as pipelines and transmission lines, refinery units and chemical processing systems.

The present invention thus relates to a method for preventing corrosion of metals in contact with liquid systems which comprises adding to the systems an effective amount of a carboxylic acid containing at least one organic hydrophobic group having 5 carbon atoms or more in combination with an amine-sulfite.

The carboxylic acid for use in the method is preferably a fatty acid or a nitrogen containing carboxylic acid. By nitrogen containing carboxylic acids are intended amino and amido carboxylic acids which can be represented by the general formula $R-X-(CH_2)_n-COOH$ whereby X is the group $-\overset{R_1}{\overset{|}{N}}-$, $$-\overset{R_1}{\overset{|}{N}}-\underset{\underset{O}{\|}}{C}- \quad \text{or} \quad -\underset{\underset{O}{\|}}{C}-\overset{R_1}{\overset{|}{N}}-$$

wherein R is an organic hydrophobic group containing at least 5 carbon atoms, $R_1$ is hydrogen, a lower alkyl group containing 1 to 4 carbon atoms or has the same meaning as R and n is an integer between 1 and 10, preferably between 1 and 5.

The organic hydrophobic groups of the fatty acids and the nitrogen containing carboxylic acids may contain inert substituents, i.e. substituents that do not adversely affect the anti-corrosive properties of the molecules. As examples of such inert, non-interfering substituents can be mentioned ether- and ester groups.

The organic hydrophobic group is suitably a straight or branched aliphatic group containing 6 to 22 carbon atoms, preferably 7 to 18 carbon atoms. As examples of such groups can be mentioned alkyl groups such as octyl, decyl, dodecyl, tetradecyl and octadecyl groups, alkenyl groups such as oleyl and linoleyl groups. The hydrophobic groups may also be naturally occuring mixtures of such groups.

In the amino carboxylic acids the group $R_1$ is preferably hydrogen or has the same meaning as R. In the amido carboxylic acids $R_1$ is preferably hydrogen or a lower alkyl group containing 1 to 4 carbon atoms. The preferred carboxylic acid is the amino carboxylic acid.

The carboxylic acids are according to the invention used in combination with a sulfite or a bisulfite of an amine. The term sulfite will be used hereinafter and will hereby also include bisulfite as in aqueous environment both sulfites and bisulfites of the amines will be present.

The amine sulfite for use in the method can for example be a fatty amine sulfite, a sulfite of an ether amine containing at least one organic hydrophobic group having 6 carbon atoms or more, a sulfite of a lower amine such as alkanol amines, ethylene or propylene di- and polyamines or mixtures of those, sulfites of cyclic amines, e.g. pyridine and morpholine and derivatives thereof. The term amine does of course include mono- as well as di- and polyamines. The sulfites include such compounds wherein the amines have been reacted with one mole or less of $SO_2$ or $H_2SO_3$ per nitrogen atom in the amine.

The preferred amine sulfite is the sulfite of an ether amine having the general formula $$R-[\text{O-alkylene}]_a-(CH_2)_m-N\left\langle\begin{array}{l}\left[(CH_2)_n-\overset{X}{\overset{|}{N}}\right]_p-X\\ \left[(CH_2)_n-\underset{X}{\underset{|}{N}}\right]_q-X\end{array}\right.$$

wherein R is an organic hydrophobic group containing at least 6 carbon atoms, a is an integer between 1 and 5, m is 0 or 1, n an integer between 2 and 10, the groups X independent of each other are hydrogen, an alkyl group having 1 to 4 carbon atoms or the group $(\text{alkylene-O})_yH$ where y is 1 to 10, p is 0,1 or 2 and q is 0 or 1, whereby however q is 0 when p is 2, and the alkylene group is an ethylene-, propylene- or isopropylene group.

Particularly preferred are the ether amines which can be represented by the general formula $$R-[\text{O-alkylene}]_a-(CH_2)_m-\overset{X}{\overset{|}{N}}-(CH_2)_n-\overset{X}{\overset{|}{N}}-X$$

where the substituents and integers have above given meaning.

The organic hydrophobic group in the ether amines is suitably a straight or branched aliphatic hydrocarbon group containing 6 to 22 carbon atoms, preferably 8 to 18 carbon atoms and most preferably 8 to 12 carbon atoms. As examples of suitable groups can be mentioned alkyl groups such as heptyl, octyl, nonyl, decyl, dodecyl, hexadecyl, octadecyl, 2-ethylhexyl, 2-ethyl-4-methylpentyl, isononyl, isodecyl, isotridecyl, isohexadecyl, iso-octadecyl, alkenyl groups such as oleyl and linoleyl. The organic hydrophobic groups may also be mixtures of naturally occuring groups.

In the groups (O-alkylene) it is understood that they can contain mixtures of ethylene, propylene and isopropylene groups.

The substituent X in the ether amines suitably represents hydrogen or alkoxy groups where y is 1 to 10, preferably X is hydrogen. The integer a is preferably 1 or 2 and m is preferably 0 when a is 1 and 0 or 1 when a is greater than 1. The integer n is preferably 2 or 3.

Examples of suitable sulfites of ether amines are those of 3-octoxypropyl amine, N(3-octoxypropyl) propylene diamine, N(3-decoxypropyl) propylene diamine, N(3-dodecoxypropyl) propylene diamine, N(2-octoxyethyl) ethylene diamine, N(2-decoxyethyl) ethylene diamine.

Combinations of amino carboxylic acids and sulfites of ether amines are preferably used in the method. Besides the particularly good corrosion inhibiting effect of the combinations, the sulfites of the ether amines have advantageous miscibility and solubility properties in hydrocarbon and water systems and they also have useful bactericidal properties.

The combination of carboxylic acid and amine-sulfite can be added to a corrosive system in the form of solutions or dispersions in water and/or organic solvent. As examples of solvents can be mentioned lower alcohols such as methanol, ethanol and isopropylalcohol, glycols and aliphatic and aromatic hydrocarbons. Mixing of the components can be carried out at room temperature or slightly elevated temperature.

The carboxylic acid and the amine sulfite are suitably added to a corrosive system in a weight ratio to each other of from 1:20 to 20:1, preferably 1:5 to 5:1.

In a particular embodiment of the invention hydrazine is used in addition to the carboxylic acid and the amine-sulfite. The mole ratio of hydrazine to carboxylic acid is suitably in the range of from 1:20 to 20:1, preferably from 1:5 to 10:1.

The invention also relates to compositions for prevention of corrosion of metals said compositions comprising the above defined carboxylic acids in combination with the defined aminesulfites. In the compositions the carboxylic acids and the amine sulfites are suitably present in a weight ratio of from 1:20 to 20:1, preferably in a weight ratio of 1:5 to 5:1. The preferred compositions comprise an amino carboxylic acid and an ether amine sulfite. The compositions may further comprise hydrazine, suitably in molar amounts of 1:20 to 20:1 with respect to the carboxylic acid.

The amount of active ingredients required for sufficient protection does of course vary with the corrosiveness of the systems. Methods for monitoring the severity of corrosion in different systems are well-known and serve as a basis for deciding the effective amount.

The combinations according to the invention generally give a substantial reduction of corrosion when present in amounts of about 1 ppm based on the weight of the corrosive liquid. The upper limit is not critical but depends on the particular compound and the particular system. Amounts up to and above 1000 ppm can be used but preferably the concentration is within the range of 1 to 200 ppm.

The combinations of carboxylic acids and amine-sulfites of the present invention are particularly useful in the different areas of oil recovery and petroleum industry. They can be used in primary, secondary and tertiary oil recovery and added in a manner known per se. They can also be incorporated in water-soluble capsules which are introduced in the wells and when the capsules dissolve the inhibitor is slowly released into the corrosive fluid. Another technique in primary oil recovery where they can be used is the squeeze treating technique whereby they are injected under pressure into the producing formation, are adsorbed on the strata and desorbed as the fluids are produced. They can further be added in the water flooding operations of secondary oil recovery as well as added to pipelines, transmission lines and refinery units.

The products of the invention can be used in combination with known inhibitors and oxygen scavengers and also in combination with additives generally used in the field such as anti-freezing agents, anti-fouling agents, surface active agents, e.g. nonionic dispersants and chelating agents.

The invention is further illustrated in the following examples which however are not intended to limit the same.

EXAMPLE 1

A hydrazine salt of N-methyl, N-carboxymethyl octadecylamide was prepared by dissolving 20 grams of the amidoacid in 75 grams of isopropanol. 1.75 grams of hydrazine dissolved in 3.25 grams of water was added and a clear solution (D) of the hydrazine salt was obtained.

A reaction product of $SO_2$ and N-dodecylpropylenediamine was prepared by reacting 20 grams of the amine dissolved in 74.8 grams of isopropanol, with 5.2 grams of $SO_2$. The temperature was kept below 40° C. during the reaction. A product solution (E) was obtained.

40 grams of solution D and 25 grams of solution E was finally mixed with 35 grams of 2-ethoxy ethanol to give a liquid product (inhibitor A) containing 5.4% of the hydrazine salt and 10.0% of the $SO_2$-amine adduct.

EXAMPLE 2

14 grams of dodecylamino propionic acid was dissolved in 40 grams of isopropanol and 40 grams of water. (Solution F.)

A reaction product of $SO_2$ and N-(3-decoxy propyl) propylenediamine was prepared by reacting 20 grams of the amine dissolved in 75 grams of isopropanol with 5 grams of $SO_2$. The temperature was kept below 40° C. during the reaction. A product solution (G) was obtained.

60 grams of solution F and 25 grams of solution G was finally mixed with 15 grams of water to give a liquid product (inhibitor B) containing 8.9% of the ampholyte and 6,2% of the $SO_2$-amine adduct.

EXAMPLE 3

A hydrazine salt of oleic acid was prepared by dissolving 20 grams of oleic acid in 71 grams of isopropanol. 2.27 grams of hydrazine dissolved in 6.73 grams of water was added at room temperature to give a clear salt solution (H).

A reaction product of N-oleyl propylenediamine and $SO_2$ was prepared by reacting 20 grams of the amine dissolved in 76.4 grams of iso-propanol with 3.6 grams of $SO_2$. The temperature was kept below 40° C. during the reaction. A product solution (I) which remained liquid when stored at a temperature of 40° C. was obtained.

40 grams of solution H and 60 grams of solution I was finally mixed to give a liquid product (inhibitor C) containing 9% of the hydrazine salt and 14.2% of the $SO_2$-amine adduct.

EXAMPLE 4

Corrosion test

Inhibitors A, B and C were tested. The dosage in ppm is referring to the active parts of the inhibitor, i.e. not the solvent.

Test method:

50 ml of crude oil and 950 ml of a brine solution with the following composition was poured into a 1000 ml E-flask.

| component | % |
|---|---|
| NaCl | 4.4 |
| $NaHCO_3$ | 0.08 |
| $CaCl_2$ | 0.06 |
| $MgCl_2$ | 0.03 |
| $MgSO_4$ | 0.01 |
| water | 95.43 |

The mixture was vigorously stirred and $CO_2$ was bubbled through for 15 minutes giving a mixture saturated on $CO_2$ and with an oxygen content less than 0.5 ppm. The temperature was kept at 25° C. A polarisation resistance instrument (Magna Corrater) equipped with 1010 mild steel electrodes was used for the corrosion measurements. After the end of the period of 15 minutes, the electrodes were put into the brine solution. After 1 hour of stabilization of the corrosion rate a corrosion reading ($C_A$) was taken, then the inhibitor was added. After further 6 hours a final corrosion reading was taken ($C_B$). During the test a $CO_2$-saturated brine was obtained by continued injection of $CO_2$ into the solution.

Since different electrodes give different initial corrosion readings, a relative corrosion rate at the end of the test period was calculated.

$$\text{Relative corrosion rate} = \frac{C_B}{C_A} \times 100$$

| INHIBITOR | DOSAGE ppm | RELATIVE CORROSION RATE |
|---|---|---|
| No inhibitor | — | 100 |
| A | 5 | 1.6 |
| B | 5 | 0.8 |
| C | 5 | 1.2 |

We claim:

1. A method for preventing corrosion of metals in contact with liquid systems, characterized in that, to the systems is added an effective amount of a carboxylic acid containing an organic hydrophobic group having at least 5 carbon atoms in combination with a sulfite or a bisulfite to an amine.

2. A method according to claim 1, characterized in that, the carboxylic acid is a nitrogen containing carboxylic acid having the general formula $$R{-}X{-}(CH_2)_n{-}COOH \text{ whereby X is the group } {-}\overset{R_1}{\overset{|}{N}}{-},\quad {-}\overset{R_1}{\overset{|}{N}}{-}\underset{\underset{O}{\|}}{C}{-} \text{ or } {-}\underset{\underset{O}{\|}}{C}{-}\overset{R_1}{\overset{|}{N}}{-}$$

wherein R is an organic hydrophobic group containing at least 5 carbon atoms, $R_1$ is hydrogen, a lower alkyl group containing 1 to 4 carbon atoms or has the same meaning as R and n is an integer between 1 and 10, preferably between 1 and 5.

3. A method according to claim 1 or 2, characterized in that, the carboxylic acid is an amino carboxylic acid.

4. A method according to claim 1 or 2, characterized in that, the amine sulfite is a sulfite or bisulfite of an ether amine having the general formula $$R{-}[\text{O-alkylene}]_a{-}(CH_2)_m{-}N\left\langle\begin{array}{l}\left[(CH_2)_n{-}\overset{X}{\overset{|}{N}}\right]_p{-}X\\ \left[(CH_2)_n{-}\underset{X}{\underset{|}{N}}\right]_q{-}X\end{array}\right.$$

wherein R is an organic hydrophobic group containing at least 6 carbon atoms, a is an integer between 1 and 5, m is 0 or 1, n is an integer between 2 and 10, the groups X independent of each other are hydrogen, an alkyl group having 1 to 4 carbon atoms or the group $(\text{alkylene-O})_yH$ where y is 1 to 10, p is 0, 1 or 2 and q is 0 or 1, provided that q is 0 when p is 2, and the alkylene group is an ethylene-, propylene- or isopropylene group.

5. A method according to claim 1 or 2, characterized in that, hydrazine is added to the system in addition to the carboxylic acid and the amine sulfite.

6. A composition for preventing corrosion of metals in contact with liquid systems, said composition comprising a carboxylic acid containing an organic hydrophobic group having at least 5 carbon atoms and an amine sulfite, whereby the weight ratio of carboxylic acid to the amine sulfite is within the range of from 1:20 to 20:1.

7. A composition according to claim 6, characterized in that the carboxylic acid is a nitrogen containing carboxylic acid having the general formula $$R{-}X{-}(CH_2)_n{-}COOH \text{ whereby X is the group } {-}\overset{R_1}{\overset{|}{N}}{-},\quad {-}\overset{R_1}{\overset{|}{N}}{-}\underset{\underset{O}{\|}}{C}{-} \text{ or } {-}\underset{\underset{O}{\|}}{C}{-}\overset{R_1}{\overset{|}{N}}{-}$$

wherein R is an organic hydrophobic group containing at least 5 carbon atoms, $R_1$ is hydrogen, a lower alkyl group containing 1 to 4 carbon atoms or has the same meaning as R and n is an integer between 1 and 10, preferably between 1 and 5.

8. A composition according to claim 6 or 7, characterized in that the amine sulfite is a sulfite of an ether amine having the general formula $$R{-}[\text{O-alkylene}]_a{-}(CH_2)_m{-}N\left\langle\begin{array}{l}\left[(CH_2)_n{-}\overset{X}{\overset{|}{N}}\right]_p{-}X\\ \left[(CH_2)_n{-}\underset{X}{\underset{|}{N}}\right]_q{-}X\end{array}\right.$$

wherein R is an organic hydrophobic group containing at least 6 carbon atoms, a is an integer between 1 and 5, m is 0 or 1, n is an integer between 2 and 10, the groups X independent of each other are hydrogen, an alkyl group having 1 to 4 carbon atoms or the group (alkylene-O)$_y$H where y is 1 to 10, p is 0, 1 or 2 and q is 0 or 1, provided that q is 0 when p is 2, and the alkylene group is an ethylene-, propylene- or isopropylene group.

9. A composition according to any of claims 6 or 7, characterized in that the weight ratio of carboxylic acid to amine sulfite is within the range of from 1:5 to 5.1.

10. A composition according to claim 8 characterized in that the weight ratio of carboxylic acid to amine sulfite is within the range of from 1:5 to 5:1.

* * * * *

UNITED STATES PATENT AND TRADEMARK OFFICE

CERTIFICATE OF CORRECTION

PATENT NO. : 4,238,348

DATED : December 9, 1980

INVENTOR(S) : LARSEN et al

It is certified that error appears in the above—identified patent and that said Letters Patent is hereby corrected as shown below:

On the cover page please insert Item

[30] Foreign Application Priority Data
November 16, 1977 [SE] Sweden 7712957-5

Signed and Sealed this

*Fifteenth* Day of *December 1981*

[SEAL]

*Attest:*

GERALD J. MOSSINGHOFF

*Attesting Officer*

*Commissioner of Patents and Trademarks*